US005271240A

United States Patent [19]

Detrick et al.

[11] Patent Number: 5,271,240

[45] Date of Patent: Dec. 21, 1993

[54] HOUSEHOLD REFRIGERATOR-FREEZER COOLING APPARATUS WITH VACUUM AS THE PRESERVING MEANS

[75] Inventors: Robert P. Detrick; Ricky G. Ledbetter, both of Medford, Oreg.

[73] Assignee: Arex, Inc., Reno, Nev.

[21] Appl. No.: 909,013

[22] Filed: Jul. 6, 1992

[51] Int. Cl.[5] ..... F25B 19/00; F25D 21/10; F25D 15/00; F24F 3/16

[52] U.S. Cl. ..... 62/268; 62/60; 62/78; 62/331; 62/382

[58] Field of Search ..... 62/60, 78, 268, 270, 62/100, 382; 426/404

[56] References Cited

U.S. PATENT DOCUMENTS

| | | | |
|---|---|---|---|
| 2,119,320 | 5/1938 | Dobrowsky | 62/268 X |
| 2,425,816 | 8/1947 | Maxson | 62/268 X |
| 2,894,845 | 7/1959 | Stoddard | 62/268 |
| 3,067,588 | 12/1962 | Whitmore | 62/268 |
| 3,216,214 | 11/1965 | Gasbarro | 62/268 X |
| 3,786,652 | 1/1974 | Bolynn | 62/78 X |
| 4,173,378 | 11/1979 | Hanson et al. | 312/296 |
| 4,557,118 | 12/1985 | Pink et al. | 62/382 |
| 4,584,841 | 4/1986 | Guillaume et al. | 62/268 X |
| 4,850,206 | 7/1989 | Larsen | 62/382 |
| 4,870,836 | 10/1989 | Pink | 62/382 |
| 4,919,955 | 4/1990 | Mitchell | 426/394 |
| 5,046,332 | 9/1991 | Herrmann et al. | 62/78 X |
| 5,095,717 | 3/1992 | Germi | 62/382 |
| 5,136,853 | 8/1992 | Girardon et al. | 62/78 |
| 5,157,940 | 10/1992 | Bertu et al. | 62/268 X |

*Primary Examiner*—Henry A. Bennet
*Assistant Examiner*—Christopher B. Kilner
*Attorney, Agent, or Firm*—Eugene M. Eckelman

[57] ABSTRACT

An inner cooled compartment for receiving articles to be preserved has a vacuum environment in it for the prolonged preservation of articles. Door closures for the compartment is associated with vacuum release valves to allow the closures to open. The inner compartment to be subject to vacuum may comprise a refrigerator area of a conventional household refrigerator or the freezer compartment thereof, or both. The vacuum storage hereof also has particular application to the vegetable tray compartment of a refrigerator and may contain a self-contained vacuum producing flexible container. The vacuum pump may be combined with the refrigerator operating structure or may be a separate outside mounted unit connected by a conduit into the compartments.

4 Claims, 4 Drawing Sheets

HOUSEHOLD REFRIGERATOR-FREEZER COOLING APPARATUS WITH VACUUM AS THE PRESERVING MEANS

BACKGROUND OF THE INVENTION

Various means in association with refrigerator structures for household use have heretofore been provided for increasing the storage life of articles in the refrigerator. For example, U.S. Pat. No. 3,357,201 provides a refrigerator with a vegetable storage compartment that uses water saturated vapor and a high humidity arranged to minimize deterioration. U.S. Pat. No. 4,173,378 relates to an airtight food storage drawer. U.S. Pat. No. 4,850,206 provides a higher humidity environment than the general refrigerator environment for storing fresh vegetables and fruits. U.S. Pat. No. 4,870,836 shows an improved meat compartment that uses cold air flow to preserve meat. Vacuum packs not associated with refrigeration means also have been used for packaging perishable products. An example of this latter means is shown by U.S. Pat. No. 4,919,955.

SUMMARY OF THE INVENTION

It is an object of the invention to provide improvements in the storage and preservation of foodstuffs in the general household refrigerator or freezer.

A more particular object is to provide a vacuum system for such refrigerator or freezer for prolonging the storage life and minimizing spoilage.

Another object is to provide a vacuum system that is particularly applicable for use with various portions of the refrigerator-freezer, for example, the vegetable tray portion of a refrigerator.

Another object is to provide a vacuum system for a refrigerator-freezer unit having means combined therewith that can be used to vacuum pack foodstuffs for storage, thus forming a complete home food preserving apparatus.

In carrying out the objects of the invention, the cooling apparatus in general comprises an inner compartment such as a refrigerator and/or freezer, door means providing access to the inner compartment, vacuum producing means associated with the compartment having an inlet communicating therewith for producing a vacuum environment and providing the prolonged preservation of articles, and vacuum release means between the compartment and atmosphere for breaking the vacuum when it is desired to open the door. The vacuum producing means may comprise an integral built-in portion of the cooling apparatus or it may be separate from the cooling apparatus with conduit communication to the inner compartment. Also, the apparatus may include an outlet fitting such as a nozzle for vacuum packing food containing packages.

The invention will be better understood and additional objects and advantages will become apparent from the following description taken in connection with the accompanying drawings.

DETAILED DESCRIPTION OF PREFERRED EMBODIMENTS

Figure 1:
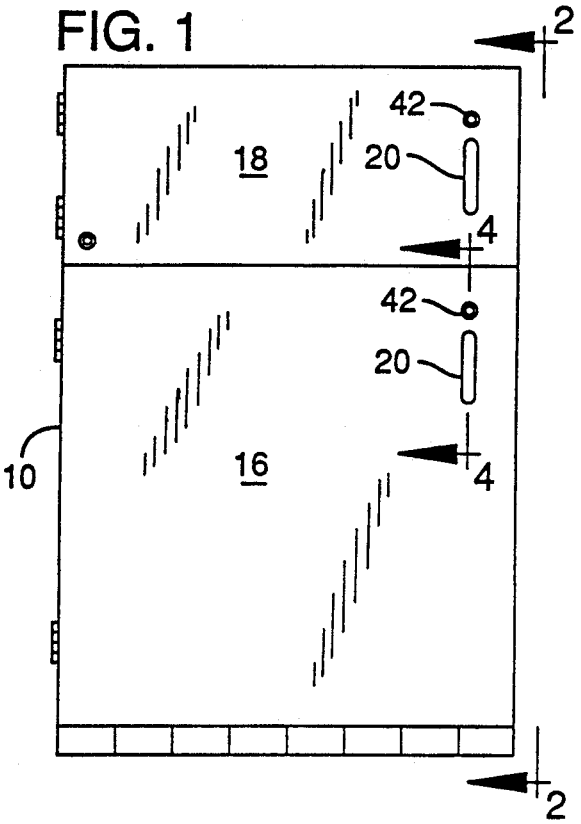
FIG. 1 is a front elevational view of a refrigerator freezer combination with which a vacuum system according to the invention is applicable.

FIGS. 1–4 show the invention as applied to cooling apparatus such as a conventional household refrigerator-freezer unit. Such a refrigerator freezer unit is designated by the numeral 10 and commonly employs a cooling compartment 12 maintained at approximately 38° F. and a freezer compartment 14 maintained below 32° F. The cooling and freezing compartments are accessible by doors 16, 18, respectively, and have suitable handles 20. These units usually have insulated wall portions 22 and a bottom and rear area 24 that includes compressor and other means 26 associated with the cooling and freezing functions.

In one form of the invention, a pressure regulated vacuum pump 30 is suitably combined with the refrigerator apparatus such as being mounted in the bottom area 24. This pump has outlet means 32 and inlet means 34, the inlet means including a conduit communicating with one or both of the cooling and freezing compartments 12 and 14. Suitable connections 36 in the rear refrigerator wall portion 22 connect the conduit to the inner compartments. Upon operation of the vacuum pump, the pressure in compartments 12 and 14 is lowered below atmospheric to a suitable vacuum environment as controlled by the pressure setting of the pump, and foodstuffs therein keep fresh considerably longer than when stored at atmospheric pressure. The doors 16 and 18 have the usual airtight gasket seals with the compartments of the refrigerator and freezer unit to maintain a vacuum environment.

Figure 2:
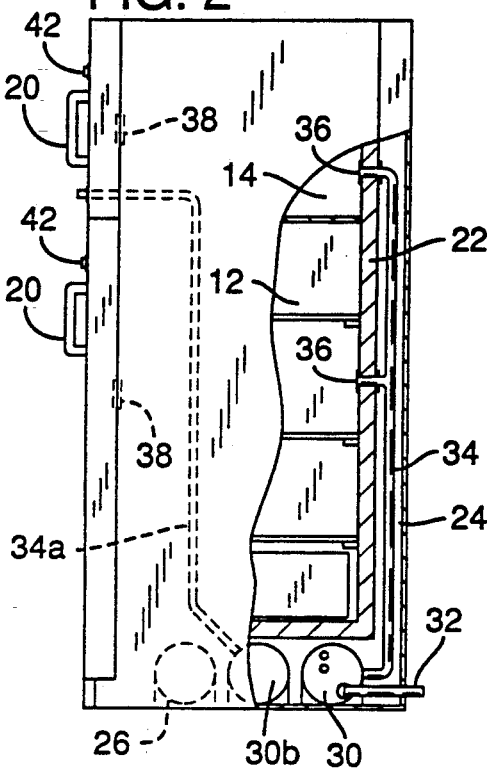
FIG. 2 is a side elevational view of the refrigerator freezer unit of FIG. 1, a portion of this view being broken away to show a vacuum installation within the unit.
Figure 4:
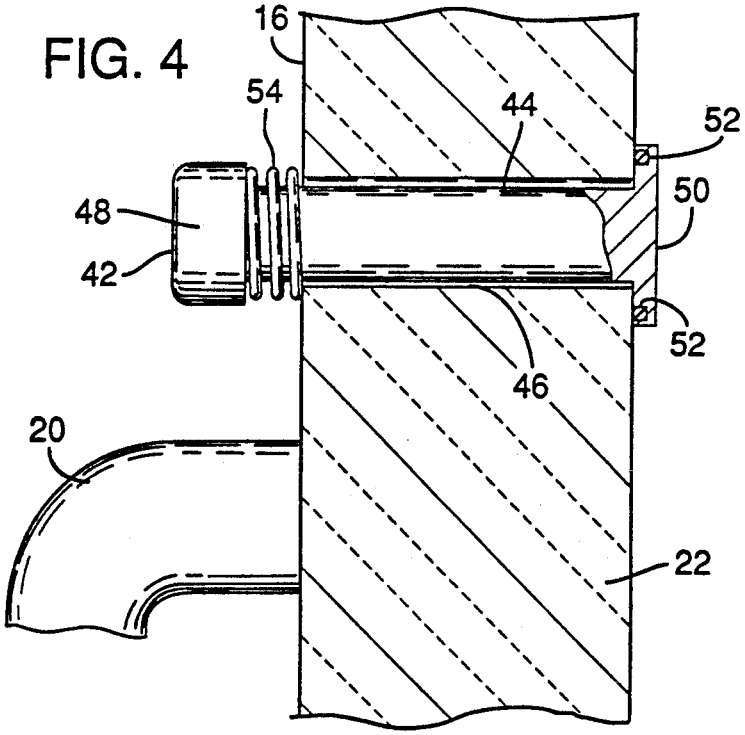
FIG. 4 is an enlarged sectional detail view of a vacuum release valve used with the present apparatus.
Figure 3:
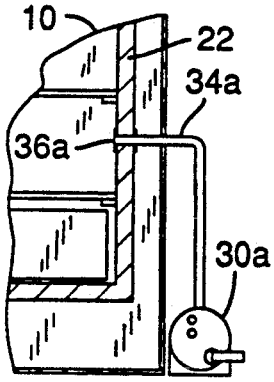
FIG. 3 is a fragmentary view taken similarly to FIG. 2 but showing an exterior vacuum source connected into the interior compartment by conduit means.

FIG. 3 illustrates the concept of mounting a vacuum pump **30*a* independently of the refrigerator-freezer unit 10, namely, exteriorly of the latter. For this purpose, the vacuum pump has independent support, such as a position closely adjacent the unit 10 and its inlet means, comprising conduit 34***a*, is passed through the rear wall 22 and connects it into the cooling and/or freezing compartments by suitable connections 36*a*. This embodiment is applicable on existing units 10 whereas the embodiment of FIG. 2 is particularly applicable to new units.

The refrigerator-freezer unit employs the usual magnetic catches 38, FIG. 2, to hold the doors shut. Also, vacuum from the interior will also hold the doors shut, and to release the vacuum when it is desired to open a door, each of the doors is provided with a vacuum release valve 42, FIG. 4, mounted in the doors. Such valve comprises a spring pressed plunger 44 slidably mounted in a slightly enlarged bore 46 in the door. The plunger 44 has a push button end 48 and a flanged sealing end 50 on the interior with a sealing engagement with the inner surface of the compartment by an annular seal 52. Sealing pressure is accomplished by a compression spring 54 having abutment between the button end 48 and the wall 22. Enlarged bore 46 provides airflow to atmosphere to break the vacuum when the push button is operated.

Figure 5:
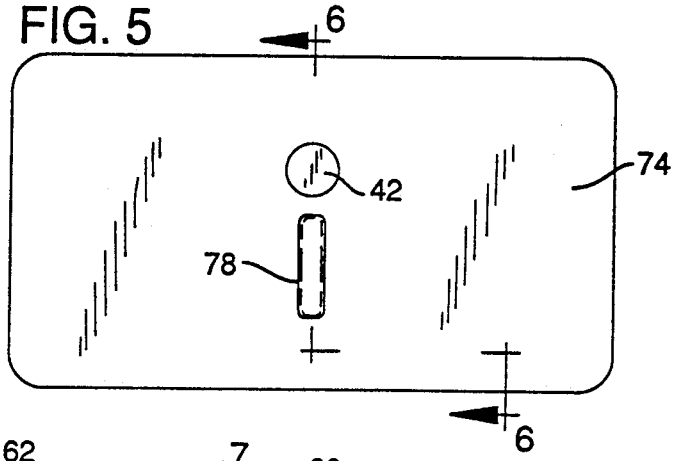
FIG. 5 is a front elevational view of a vegetable tray structure that may be combined with a conventional refrigerator and that incorporates a concept of the present invention.

A particular application of the vacuum concept of the invention is associated with a special vegetable tray structure that is isolated from the rest of the inner compartment of the refrigerator. In this connection, reference is made to FIGS. 5, 6 and 7. The vegetable tray structure comprises an outer housing 60 with enclosing top wall 62, bottom wall 64, side walls 66, and rear wall 68. The front of the housing 60 is open.

The interior of the housing includes support rails 70 for slidably supporting an open top vegetable tray 72 for movement into and out of the housing 60. This tray has a front wall 74 of enlarged dimension, namely, at least as large as the front edge of the housing 60, and the inner surface of the front wall is capable of sealed engagement against the housing 60 by a peripheral seal 76, whereby the interior of the housing 60 and the vegetable tray are sealed to atmosphere.

Figure 6:
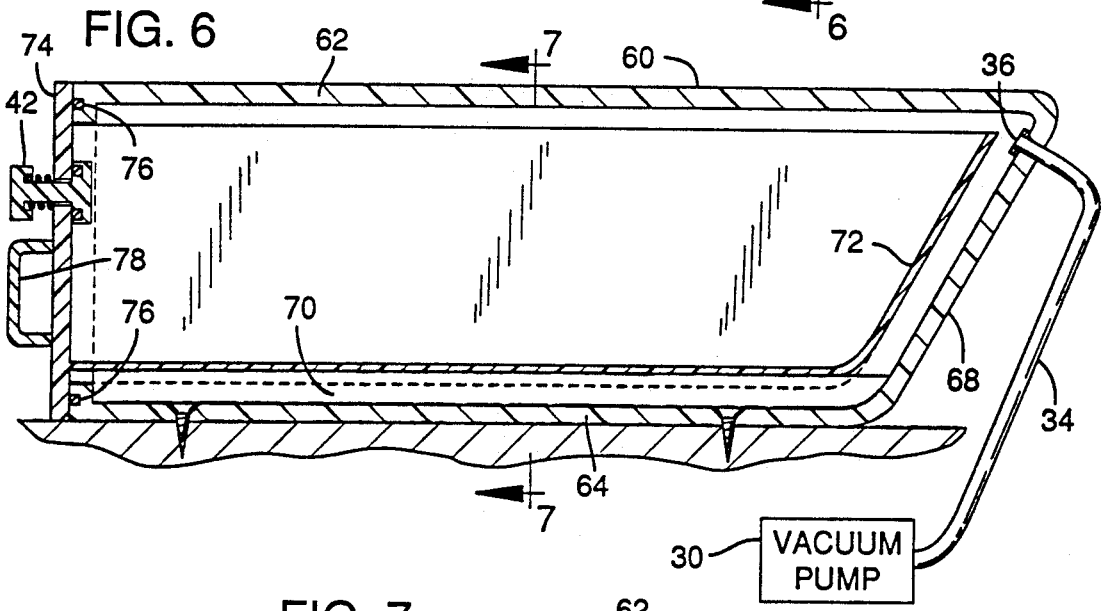
FIG. 6 is a vertical longitudinal sectional view taken on the line 6—6 of FIG. 5.
Figure 7:
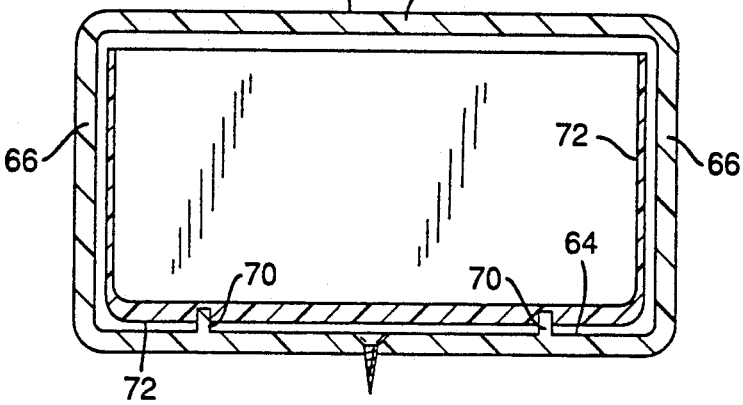
FIG. 7 is a cross sectional view taken on the line 7—7 of FIG. 6.

Vacuum for this vegetable tray arrangement is supplied by the vacuum pump 30 and conduit 34 through a connection 36 similar to the other connections communicating with upper portions of the refrigerator, as seen diagrammatically in FIG. 6. Upon the application of vacuum to the housing 60, and with the vegetable tray 72 moved to its inner position for sealing at the front, the interior of the housing is subjected to a vacuum for preservation of vegetables in the tray. The tray 72 is held in sealing engagement by the vacuum therein and its front wall 74 includes a vacuum release valve 42 of the type shown in FIG. 4, for releasing the vacuum when it is desired to pull the tray out. Also, it is preferred that the front wall 74 have a handle 78 immediately below the valve 42 for convenient operation of the valve and the handle with one hand.

Figure 8:
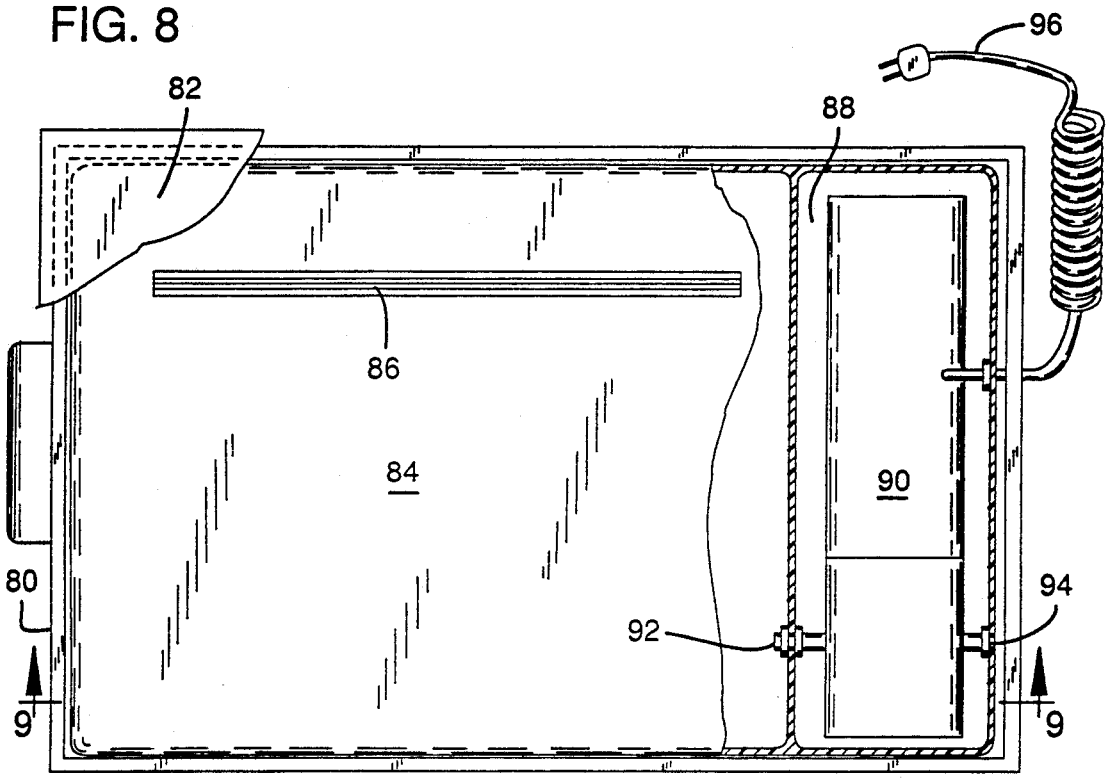
FIG. 8 is a top plan view partly broken away of another form of vegetable tray that may be combined with a conventional refrigerator and that incorporates a further concept of the invention.
Figure 9:
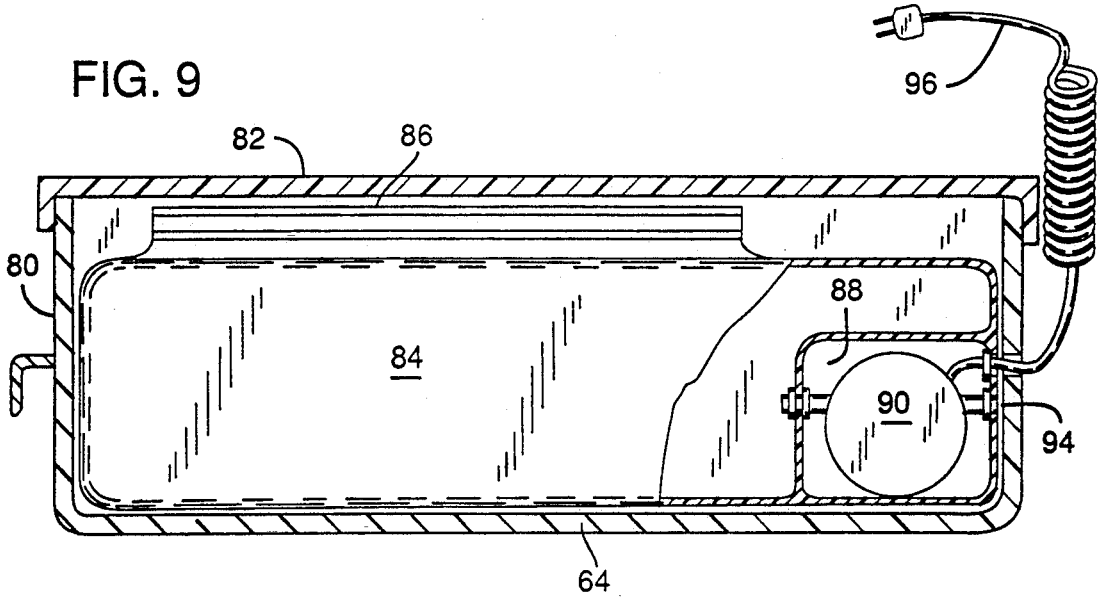
FIG. 9 is a longitudinal vertical sectional view partly broken away taken on the line 9—9 of FIG. 8.

FIGS. 8 and 9 illustrate a further concept of applying the preserving vacuum to a vegetable tray. In this form of the invention, a pull-out tray 80 with a removable lid 82 is supported in the refrigerator. This tray supports a plastic or other flexible type of bag 84 capable of holding foodstuffs. The bag has an airtight access opening 86 such as a zip lock opening. The bag also has an auxiliary compartment 88 that encloses a pressure regulated vacuum pump 90. The inlet 92 of the pump communicates with the interior of the bag 84 and its outlet 94 exhausts through the bag to the interior of the refrigerator. Vacuum pump 90 is electrically driven and includes a power cord 96 arranged to be plugged in a suitable fitting combined with the usual outlet socket for the refrigerator light bulb. By this arrangement, power to the vacuum pump is made available during those times that power reaches the light bulb socket, namely, when the door to the refrigerator is open.

When foodstuff is to be put in the bag 84, the tray 80 is first pulled out so that access to the inner or vacuum bag can be made available by removing the lid 82 of the tray. The sealed opening 86 is opened and the foodstuff inserted in the bag. The opening 86 is then closed whereupon the pump, being in operation at this time because the door to the refrigerator is open, will evacuate the air from the bag. The bag, being flexible, will collapse onto the foodstuff. This evacuation of air from the bag occurs instantaneously or at least before the power to the pump is shut off by a closure of the refrigerator door. If necessary, the refrigerator door can be held open if additional vacuum is needed in the bag. Power cord 96 has an expandable coiled portion 98 incorporated therein that allows the tray to be moved out to an access position. Power to the pump may come from an outside source if desired.

Figure 10:
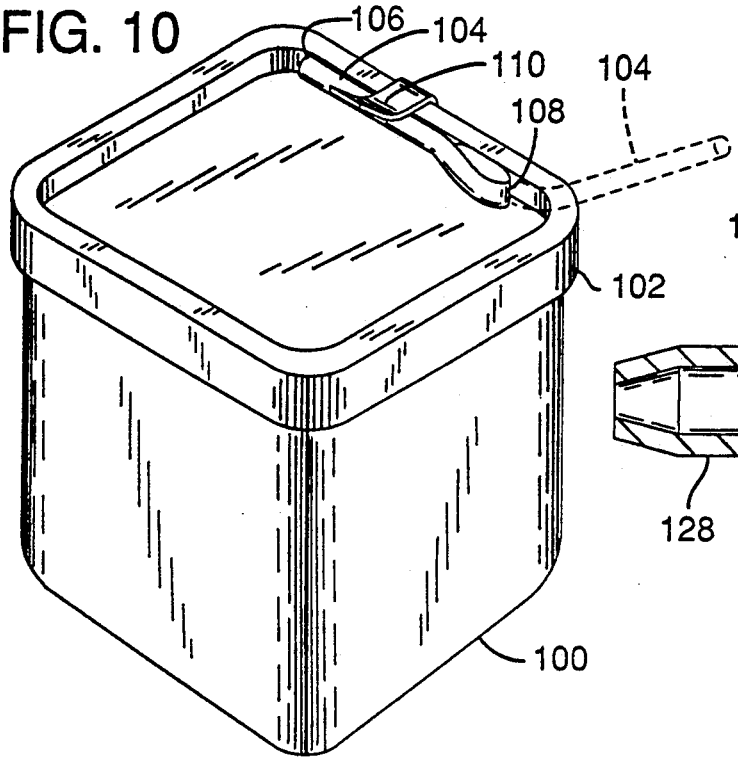
FIG. 10 is a perspective view of a first form of vacuum pack container arranged to be provided with negative pressure from a vacuum system employed with a freezing compartment of a refrigerator.
Figure 13:
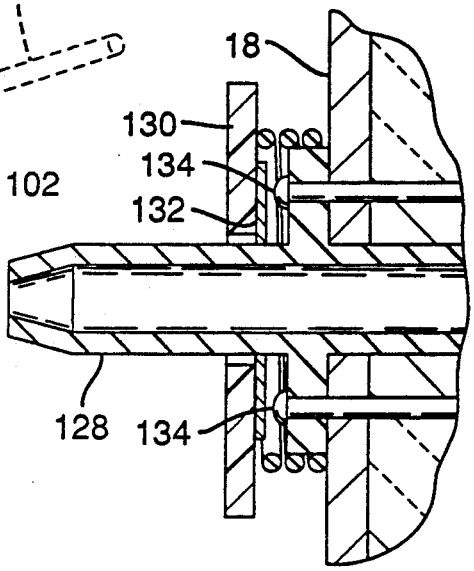
FIG. 13 is a sectional view of a nozzle construction that provides an exterior source of vacuum for vacuum packaging of containers such as those shown in FIGS. 10 and 12.

FIGS. 10–13 show a vacuum packaging structure that provides convenience in preserving small amounts of food in the freezer, such as leftovers or small packages. One form of package that may be used is shown in FIG. 10 and comprises a container 100, such as a plastic container, having an airtight lid 102. The lid has an integral flexible tube 104 having one end 106 sealed in the lid and communicating with the interior of the container. As will be seen, the tube 104 can be connected to a source of vacuum and then closed to maintain a vacuum environment that has been provided in the container. Closing of the tube is accomplished by making a crimp 108 in an end portion of the tube and holding this crimp by a spring tab 110 on the lid. The end 106 of the tube at the upper surface of the lid provides an initial crimp and seal until the final crimp and seal 108 can be made.

Figure 12:
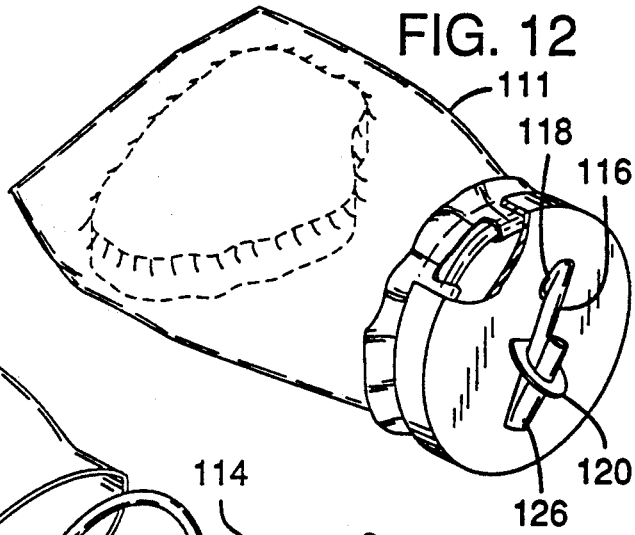
FIG. 12 is a perspective view partly broken away of the assembled package of FIG. 11.
Figure 11:
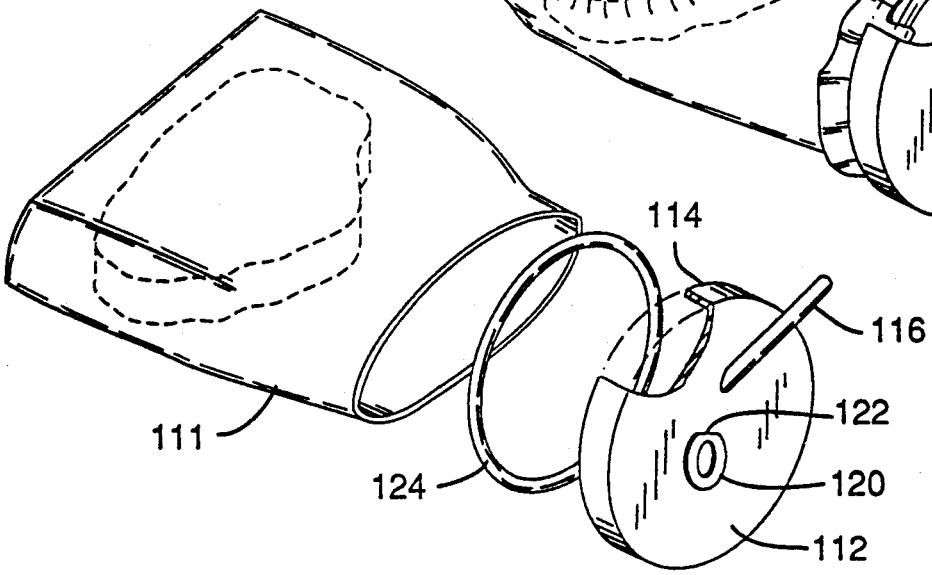
FIG. 11 is an exploded view partly broken away of a second form of vacuum pack container.

FIGS. 11 and 12 show another vacuum packaging form and is designed for plastic bags 111. In this form, a closure wall or lid 112, having an edge flange 114, has an integral flexible tube 116 with one end 118 sealed in the lid and communicating with the other side of the lid. The surface of the closure wall 112 from which the tube projects has a ring 120 connected integrally to this surface by a hinge 122. This ring and its hinge may comprise an integral molded part of the closure wall. Closing of the tube is accomplished by making a crimp 126 in an end portion of the tube and inserting the doubled back portion through the ring 120, FIG. 12. Forming a part of the FIG. 11 embodiment is a clamp ring 124 arranged by its structure and dimension to snugly engage the flange 114 of the closure wall 112.

To seal a bag 111, the open end of the bag is inserted through the ring 124 and doubled back a short distance. The ring 124 is then forced into engagement with the closure wall 112 with the bag end pinched between these two members. The bag can then be subjected to vacuum and the tube 116 sealed. The tube 116 is crimped at the sealed wall end 118 and provides an initial crimp and seal until the final crimp and seal 126 can be made. A convenient system for vacuum packaging according to the concepts of FIGS. 10 and 11 comprises a vacuum pump 30*b*, FIG. 1, combined with a refrigerator-freezer unit 10 and having its vacuum source line 34*a* leading upward into the freezer compartment 14. Such line extends in an out-of-the-way position along an inside wall of the refrigerator and into the freezer compartment. It has a nozzle outlet 128, shown in detail in FIG. 13, in the freezer door. Preferably this nozzle is adjacent the hinge side of the door, and the source line 34*a* adjacent this hinged portion is flexible to allow opening and closing of the door.

Nozzle 128 supports a spring pressed switch button 130 having a switch plate 132 thereon arranged to engage switch contacts 114 when the button is pressed. The switch plate and contacts are in an operating electrical circuit for the vacuum pump whereby a vacuum source through the nozzle 128 is controlled by operation of the switch. The free end of tubes 104 and 116, or suitable adapter fittings, are arranged to temporarily fit on the nozzle for receiving the vacuum for its package.

The system for vacuum packaging as illustrated in FIGS. 1 and 10–13 is as stated, useful for vacuum packaging small food articles. The association of the nozzle with the freezer compartment provides convenience in such instances since this small packaging is usually related to this compartment of the refrigerator.

In accordance with the invention, a vacuum condition in a refrigerator or freezer will maintain food articles in a fresh state for a much greater time than when the articles are subjected to atmosphere. The vacuum is selectively controlled for its most efficient operation, namely, a level of vacuum that substantially eliminates air but at the same time does not produce dehydration. It is found that a vacuum pressure of approximately 600 millimeters of mercury, as compared to 760 which comprises atmospheric pressure, provides a satisfactory accomplishment of the invention. The vacuum packaging shown in FIGS. 1 and 10–13, however, preferably uses a greater negative pressure.

The combination of the invention as shown in FIG. 2 provides a complete home food preserving unit.

It is to be understood that the forms of our invention herein shown and described are to be taken as preferred examples of the same and that various changes in the shape, size and arrangement of parts may be resorted to without departing from the spirit of our invention or the scope of the subjoined claims.

Having thus described our invention, we claim:

1. Cooling apparatus for the prolonged storage of articles comprising:

an inner compartment for receiving articles to be preserved, door means on said inner compartment providing access thereto, vacuum producing means associated with said inner compartment having an inlet communicating with said inner compartment for producing a vacuum environment for said inner compartment upon operation of said vacuum producing means whereby to provide the prolonged preservation of articles in said compartment, second vacuum producing means, and an outlet from said second vacuum producing means extending to a point that is exteriorly of said cooling apparatus for supplying vacuum for a secondary use.

2. An apparatus for vacuum packaging food articles comprising:

cooling means for preserving food, a refrigerating compartment in said cooling means, a freezer compartment in said cooling means, vacuum producing means associated with said cooling means, and an outlet from said vacuum producing means on the exterior of said cooling means producing a vacuum for use in vacuum packaging articles.

3. The apparatus of claim 2 wherein said outlet is associated with said freezer compartment.

4. The apparatus of claim 3 including control means at said outlet controlling the operation of said vacuum producing means.

* * * * *